US010310403B2

(12) United States Patent
Tomiie

(10) Patent No.: US 10,310,403 B2
(45) Date of Patent: Jun. 4, 2019

(54) IMAGE FORMING APPARATUS

(71) Applicant: KYOCERA Document Solutions Inc., Osaka (JP)

(72) Inventor: Norio Tomiie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/969,385

(22) Filed: May 2, 2018

(65) Prior Publication Data

US 2018/0335715 A1 Nov. 22, 2018

(30) Foreign Application Priority Data

May 22, 2017 (JP) ..... 2017-100938

(51) Int. Cl.

| | |
|---|---|
| ***G03G 15/02*** | (2006.01) |
| ***G03G 15/043*** | (2006.01) |
| ***G03G 15/00*** | (2006.01) |
| ***G03G 21/06*** | (2006.01) |

(52) U.S. Cl.

CPC ..... *G03G 15/0266* (2013.01); *G03G 15/0216* (2013.01); *G03G 15/043* (2013.01); *G03G 15/5037* (2013.01); *G03G 15/55* (2013.01); *G03G 21/06* (2013.01)

(58) Field of Classification Search

CPC ..... G03G 15/0258

See application file for complete search history.

(56) References Cited

U.S. PATENT DOCUMENTS

| | | | | |
|---|---|---|---|---|
| 7,826,754 | B2 * | 11/2010 | Kurita | G03G 15/5037 399/26 |
| 9,134,644 | B2 * | 9/2015 | Yamaguchi | G03G 15/55 |
| 9,727,001 | B2 * | 8/2017 | Kaneko | G03G 15/5037 |
| 10,054,869 | B2 * | 8/2018 | Ishida | G03G 15/0216 |

FOREIGN PATENT DOCUMENTS

JP H 8-152766 A 6/1996

* cited by examiner

*Primary Examiner* — Clayton E. LaBalle
*Assistant Examiner* — Leon W Rhodes, Jr.
(74) *Attorney, Agent, or Firm* — Stein IP, LLC

(57) ABSTRACT

An image forming apparatus has an image carrying member, a charging member, an exposing device, a destaticizer, a high-voltage generation circuit, a current detector, and a controller. The controller is configured to execute a contamination state check mode having a potential saturation step where the surface potential of the image carrying member is saturated by applying a DC voltage alone to the charging member, an exposure step where the image carrying member of which the surface potential is saturated is exposed to light in an exposure pattern extending continuously over its entire area in the main scanning direction while being displaced at a constant rate in the sub-scanning direction by the exposing device, and a current detection step where the charging current that passes while the exposure pattern formed on the surface of the image carrying member passes through the charging member is detected by the current detector.

8 Claims, 5 Drawing Sheets

IMAGE FORMING APPARATUS

INCORPORATION BY REFERENCE

This application is based upon and claims the benefit of priority from the corresponding Japanese Patent Application No. 2017-100938 filed on May 22, 2017, the entire contents of which are incorporated herein by reference.

BACKGROUND

The present disclosure relates to an image forming apparatus, such as a copier, a printer, a facsimile machine, a multifunction peripheral having their functions integrated together, that is provided with a charging member in contact with an image carrying member. More particularly, the present disclosure relates to a method for estimating the life of a charging member.

In image forming apparatuses adopting an electro-photographic process, there are used, as a means for electrostatically charging uniformly the surface of a photosensitive drum which is an image carrying member, charging devices of a corona charging type such as scorotron charging devices and corotron charging devices provided with a corona discharge device, and charging devices of a contact charging type provided with an electrically conductive charging member as exemplified by a charging roller. In recent years, instead of the charging devices of a scorotron type or a corotron type, charging devices of a contact charging type are used that are provided with a charging member (such as a charging roller) which is arranged in contact with or close to a photosensitive drum and which electrostatically charges the photosensitive drum and that generate a smaller amount of ozone.

In the charging devices of a contact charging type, a charging member makes contact with a photosensitive drum, and thus toner external additive with high electrical resistance having slipped by a cleaning blade attaches to the charging member. As the attachment amount of toner external additive increases over a long period of use of the charging device, the chargeability of a part of the charging roller to which the toner external additive is attached decreases. This inconveniently makes the surface potential of the photosensitive drum locally low and results in a foggy image.

Conventionally, the toner external additive attached to the charging member is removed by bringing a charging member cleaning member comprising a sponge or a brush into contact with the charging member. However, performing continuous printing of high-density images or continuous printing in a high-temperature, high-humidity environment or in a low-temperature, low-humidity environment may increase the amount of toner external additive slipping by a cleaning blade and also increase the amount of toner external additive attaching to the charging member. Thus, with the charging member cleaning member, it is sometimes impossible to sufficiently remove the toner external additive attached to the charging member.

As a solution, there have been proposed methods for detecting the life of a charging member when its chargeability decreases due to the contamination of the charging member. For example, according to a known method, there are provided a charging means whereby the surface of an image carrying member is electrostatically charged uniformly by a charging member in contact with the surface of the image carrying member, an exposure means whereby the surface of the image carrying member is exposed to light, a detection means whereby the charging current passing during the electrostatically charging by the charging means is detected, and a means whereby a warning that the charging member reaches the end of its life is given when the charging current reaches a predetermined value, and, when the charging current for detection is equal to or lower than a set value, it is determined that the charging member has reached the end of its life and a warning is given.

SUMMARY

According to one aspect of the present disclosure, an image forming apparatus includes an image carrying member, a charging member, an exposing device, a destaticizer, a high-voltage generation circuit, a current detector, and a controller. On the surface of the image carrying member, a photosensitive layer is formed. The charging member makes contact with the surface of the image carrying member and electrostatically charges the image carrying member. The exposing device scans, while exposing to light, the surface of the image carrying member electrostatically charged by the charging member to form an electrostatic latent image on the image carrying member. The destaticizer removes electric charge remaining on the surface of the image carrying member. The high-voltage generation circuit applies an oscillating voltage having a DC voltage and an AC voltage superimposed on each other to the charging member. The current detector detects a charging current that passes between the charging member and the image carrying member. The controller controls the high-voltage generation circuit. The controller is configured to execute a contamination state check mode including a potential saturation step where, when no image is being formed, the surface potential of the image carrying member is saturated by applying the DC voltage alone to the charging member and stopping the drive of the destaticizer, an exposure step where the image carrying member of which the surface potential is saturated in the potential saturation step is exposed to light in an exposure pattern extending continuously over its entire area in the main scanning direction while being displaced at a constant rate in the sub-scanning direction by the exposing device, and a current detection step where the charging current that passes while the exposure pattern formed on the surface of the image carrying member in the exposure step passes through the charging member is detected by the current detector. The contamination state check mode is a mode in which a contamination state of the charging member in the main scanning direction is checked based on the charging current detected in the current detection step.

Further features and advantages of the present disclosure will become apparent from the description of embodiments given below.

DETAILED DESCRIPTION

Figure 1:
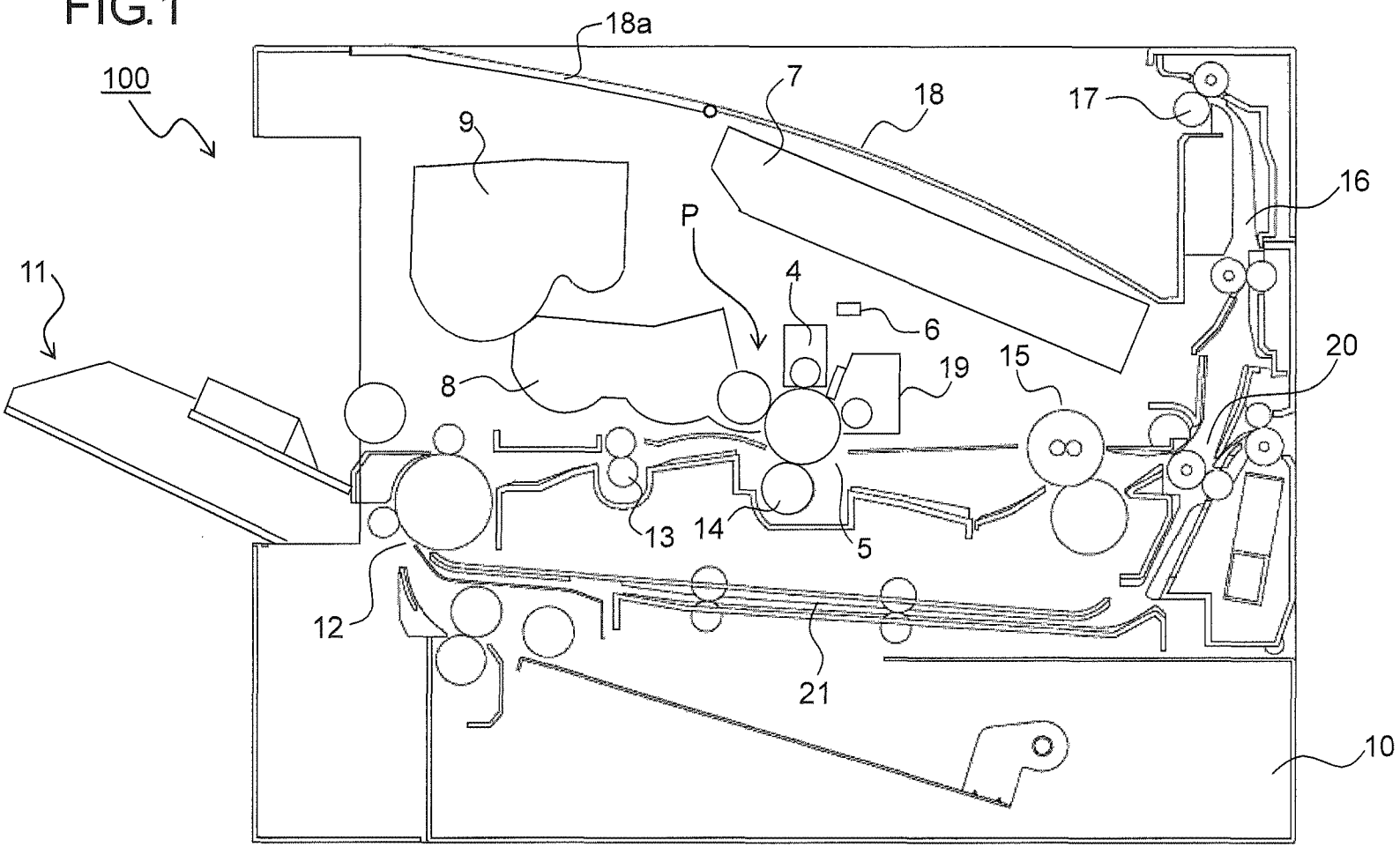
FIG. 1 is a side sectional view showing an internal structure of an image forming apparatus according to one embodiment of the present disclosure.

Hereinafter, an embodiment of the present disclosure will be described with reference to the accompanying drawings. FIG. 1 is a side sectional view showing an internal structure of an image forming apparatus 100 according to one embodiment of the present disclosure. Inside the image forming apparatus (here a monochrome printer) 100, an image forming portion P is arranged which forms a monochrome image through the processes of electrostatic charging, exposure to light, image development, and image transfer. In the image forming portion P, there are arranged, along the rotation direction of a photosensitive drum 5 (the counter-clockwise direction in FIG. 1), a charging device 4, an exposing device (such as a laser scanning unit) 7, a developing device 8, a transfer roller 14, a cleaning device 19, and a destaticizer 6.

The photosensitive drum 5 is, for example, formed by vapor-depositing, as a photosensitive layer, an amorphous silicon layer, which is a positively chargeable photoconductor, on the surface of a drum pipe of aluminum. The photosensitive drum 5 is driven to rotate about a support shaft at a fixed speed by a drum driving portion (unillustrated).

Image formation proceeds as follows. The photosensitive drum 5 which rotates in the counter-clockwise direction in FIG. 1 is electrostatically charged uniformly by the charging device 4. Then, an electrostatic latent image is formed on the photosensitive drum 5 by a laser beam from the exposing device 7 based on document image data. Then, developer (hereinafter, referred to as toner) is attached to the electrostatic latent image by the developing device 8, and thereby a toner image is formed.

Toner is fed to the developing device 8 from a toner container 9. Image data is transmitted from a personal computer (unillustrated) or the like. The destaticizer 6 which irradiates the surface of the photosensitive drum 5 with destaticizing light to remove electric charge remaining on the surface of the photosensitive drum 5 is arranged on the downstream side of the cleaning device 19 in the rotation direction of the photosensitive drum 5.

Toward the photosensitive drum 5 on which the toner image has been formed as described above, a sheet (recording medium) is conveyed from a sheet feed cassette 10 or a manual sheet feed device 11 via a sheet conveyance passage 12 and a registration roller pair 13. Then, by the transfer roller 14, the toner image formed on the surface of the photosensitive drum 5 is transferred to the sheet. The sheet having the toner image transferred to it is separated from the photosensitive drum 5, and is conveyed to a fixing device 15, where the toner image is fixed. The sheet which has passed through the fixing device 15 is conveyed through a sheet conveyance passage 16 to an upper part of the apparatus. When an image is formed only on one side of the sheet (during single-sided printing), the sheet is discharged onto a discharge tray 18 by a discharge roller pair 17.

On the other hand, when images are formed on both sides of the sheet (during double-sided printing), after the tail end of the sheet passes through a branching portion 20 of the sheet conveyance passage 16, the conveyance direction is reversed. Thus, the sheet is distributed into a reverse conveyance passage 21 which branches off the branching portion 20, and is conveyed again to the registration roller pair 13 with the image side reversed. Then, the next toner image formed on the photosensitive drum 5 is transferred to the side of the sheet on which an image has not yet been formed by the transfer roller 14. The sheet to which the toner image has been transferred is transported to the fixing device 15, where the toner image is fixed, and is then discharged onto the discharge tray 18 by the discharge roller pair 17.

Figure 2:
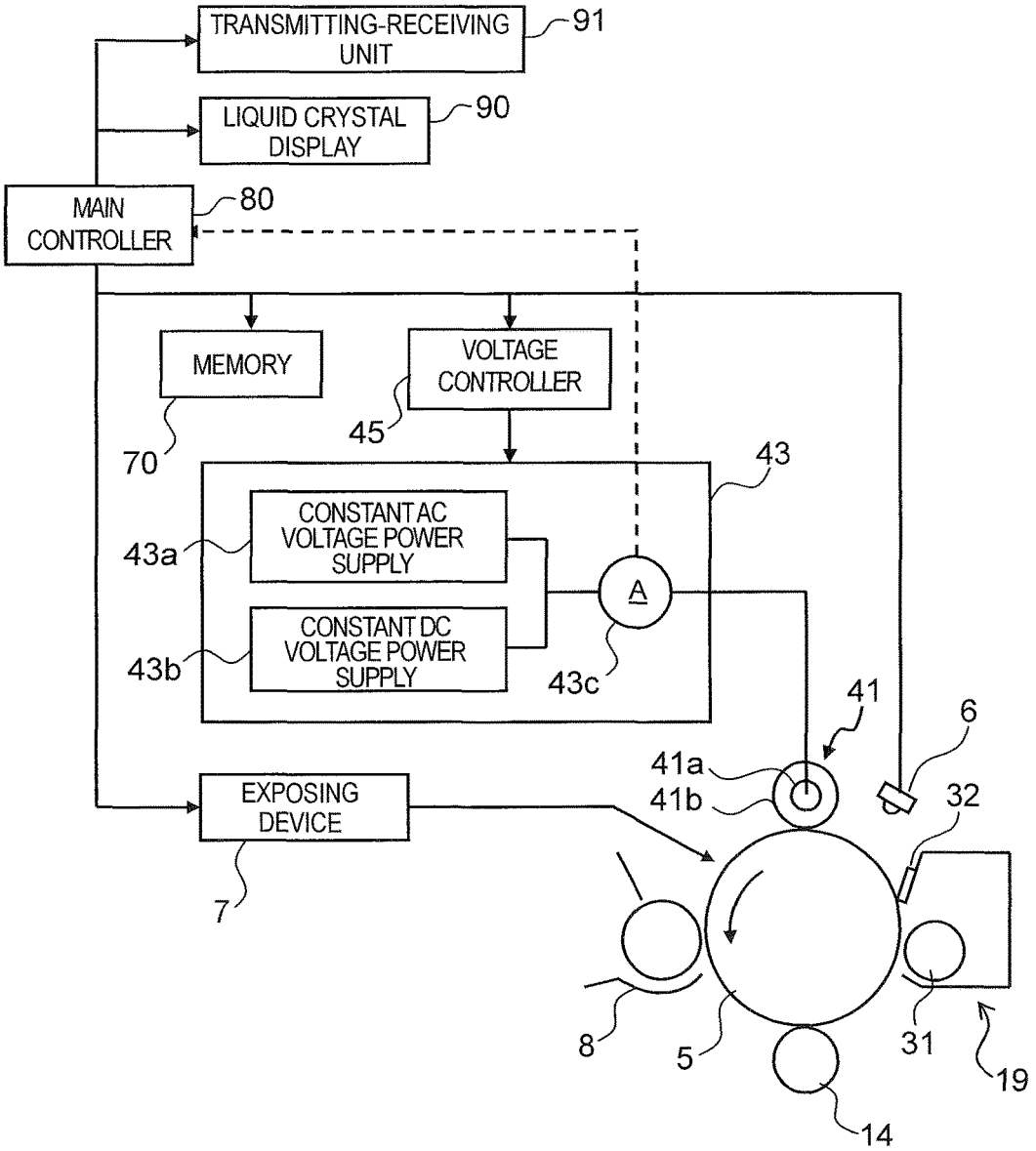
FIG. 2 is a partly enlarged view around an image forming portion including controlling channels of a charging device.

FIG. 2 is a partly enlarged view around the image forming portion P including controlling channels of the charging device 4. The charging device 4 has a charging roller 41 which is arranged to be in contact with the photosensitive drum 5 and which electrostatically charges the photosensitive drum 5.

The charging roller 41 is formed by covering a metal core 41*a* with an electrically conductive layer 41*b* made of an electrically conductive and elastic material such as epichlorohydrin rubber, and is arranged to be in contact with the photosensitive drum 5. As shown in FIG. 2, as the photosensitive drum 5 rotates in the counter-clockwise direction, the charging roller 41 in contact with the surface of the photosensitive drum 5 follows this by rotating in the clockwise direction. Here, a predetermined voltage is applied to the charging roller 41 so that the surface of the photosensitive drum 5 is electrostatically charged uniformly.

The charging roller 41 is connected to a high-voltage generation circuit 43 which generates an oscillating voltage having a DC voltage and an AC voltage superimposed on each other. The high-voltage generation circuit 43 includes a constant AC voltage power supply 43*a*, a constant DC voltage power supply 43*b*, and a current detector 43*c*. The constant AC voltage power supply 43*a* outputs a sine-wave AC voltage generated, by a booster transformer (unillustrated), from a low DC voltage modulated into pulses. The constant DC voltage power supply 43*b* outputs a DC voltage obtained by rectifying a sine-wave AC voltage generated, by the booster transformer, from a low DC voltage modulated into pulses. The current detector 43*c* detects the DC current value between the charging roller 41 and the photosensitive drum 5.

Now, a description will be given of a control system in the image forming apparatus 100 with reference to FIG. 2. In the image forming apparatus 100, a main controller 80 including a CPU and the like is provided. The main controller 80 is connected to a memory 70 including ROM, RAM, and the like. The main controller 80 controls components (such as the charging device 4, the destaticizer 6, the exposing device 7, the developing device 8, the transfer roller 14, the cleaning device 19, the fixing device 15, and a voltage controller 45) of the image forming apparatus 100 based on control programs and control data stored in the memory 70.

The voltage controller 45 controls the high-voltage generation circuit 43 which applies an oscillating voltage to the charging roller 41. The voltage controller 45 may be configured as a control program stored in the memory 70.

To the main controller 80, a liquid crystal display 90 and a transmitting-receiving unit 91 are connected. The liquid crystal display 90 functions as a touch panel to permit a user to make various settings for the image forming apparatus 100, and displays the status of the image forming apparatus 100, the status of image formation, the number of printed sheets, and the like. The transmitting-receiving unit 91 communicates with an external device over a telephone network or the Internet.

As described previously, as the amount of toner external additive attached to the charging roller 41 increases over a long period of use of the charging device 4, the chargeability of a part of the charging roller 41 to which the toner external additive is attached decreases. This makes the surface potential of the photosensitive drum 5 locally low, and results in a foggy image. As a solution, in the image forming apparatus 100 according to the present disclosure, a contamination state check mode is executable which checks the local contamination state of the charging roller 41. This contamination state check mode is executed when the power to the image forming apparatus 100 is turned on, or on recovery from an energy-saving mode (sleep mode) for limiting the supply of electric power to the components and devices constituting the image forming apparatus 100 when the image forming apparatus 100 has performed no image formation for a predetermined period, or every predetermined number of printed sheets after the last execution of the contamination state check mode.

Figure 3:
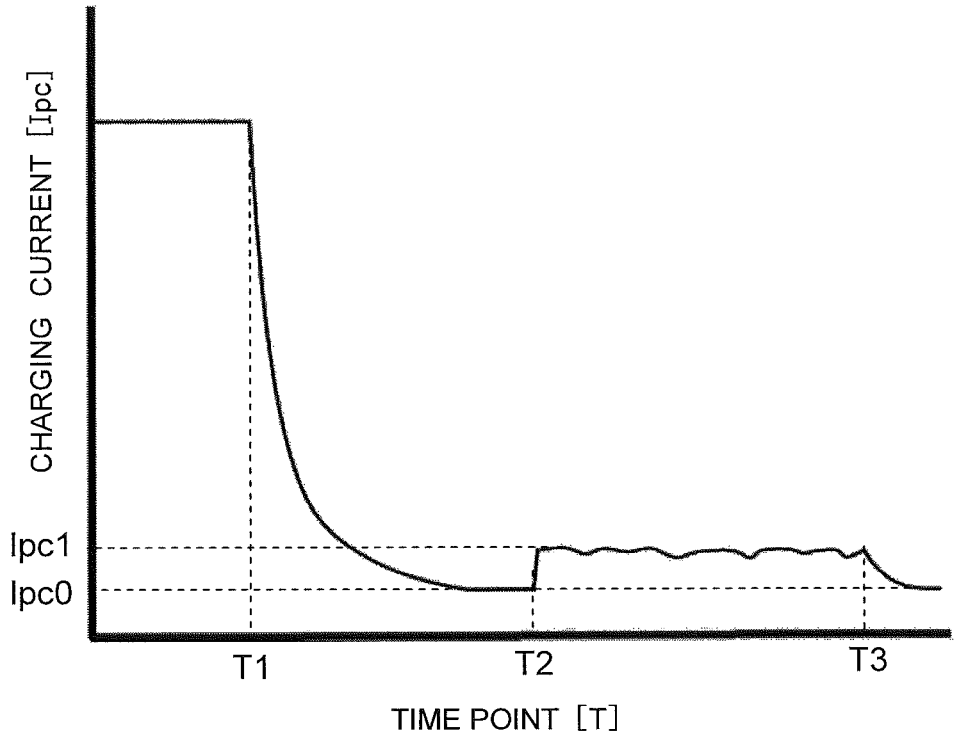
FIG. 3 is a graph showing time variation of a charging current passing from a charging roller to a photosensitive drum during execution of a contamination state check mode in the image forming apparatus.

FIG. 3 is a graph showing time variation of the charging current Ipc passing from the charging roller 41 to the photosensitive drum 5 during execution of the contamination state check mode in the image forming apparatus 100. With reference to FIGS. 1 to 3, a detailed description will be given of a procedure for executing the contamination state check mode in the image forming apparatus 100 according to the present disclosure. First, a control signal is transmitted from the main controller 80 to the voltage controller 45 so that, while the photosensitive drum 5 is being driven to rotate, a DC voltage (here 300 V) is applied from the constant DC voltage power supply 43*b* to the charging roller 41. Then, at time point T1, the electric current to the destaticizer 6 is cut off so that the surface potential of the photosensitive drum 5 equals the DC voltage applied to the charging roller 41.

Rotating the photosensitive drum 5 several turns (for example three turns) in this state brings the surface potential of the photosensitive drum 5 into a saturation state, where the charging current Ipc ceases to pass from the charging roller 41 to the photosensitive drum 5. Under the influence of electric current leakage and dark decay in the photosensitive drum 5, as shown in FIG. 3, the charging current Ipc does not completely become zero, but becomes a given value (Ipc0) which is close to zero.

Then, with the surface potential of the photosensitive drum 5 in the saturation state, the surface of the photosensitive drum 5 is exposed to a laser beam from the exposing device 7 in a predetermined pattern. An example of the exposure pattern is shown in FIG. 4.

The exposure pattern E is formed by displacing a plurality of blocks, which have been partitioned from each other in the main scanning direction of the photosensitive drum 5 (the axial direction, the direction indicated by arrow X), in steps in the sub-scanning direction (the circumferential direction, the direction indicated by arrow Y). When the sampling (reading) period for detecting the charging current Ipc is 1 msec, then, when the width of the blocks (an exposure duration) Δt is 10 msec, sampling can be performed 10 times per block. The image forming apparatus 100 which can handle a sheet of A3 size (297 mm×420 mm) requires an exposure pattern E that is partitioned into 30 or more blocks; it is thus possible to perform sampling 30×10=300 times. Thus, Δt is preferably equal to or longer than 10 msec.

If the length of the exposure pattern E in the sub-scanning direction is larger than the circumference of the photosensitive drum 5, under the influence of the previous exposure to light, the surface potential of the photosensitive drum 5 may not completely return to the saturation state; this may make it impossible to accurately detect the charging current Ipc. Thus, the length of the exposure pattern E in the sub-scanning direction is preferably equal to or smaller than the circumference of the photosensitive drum 5.

Figure 4:
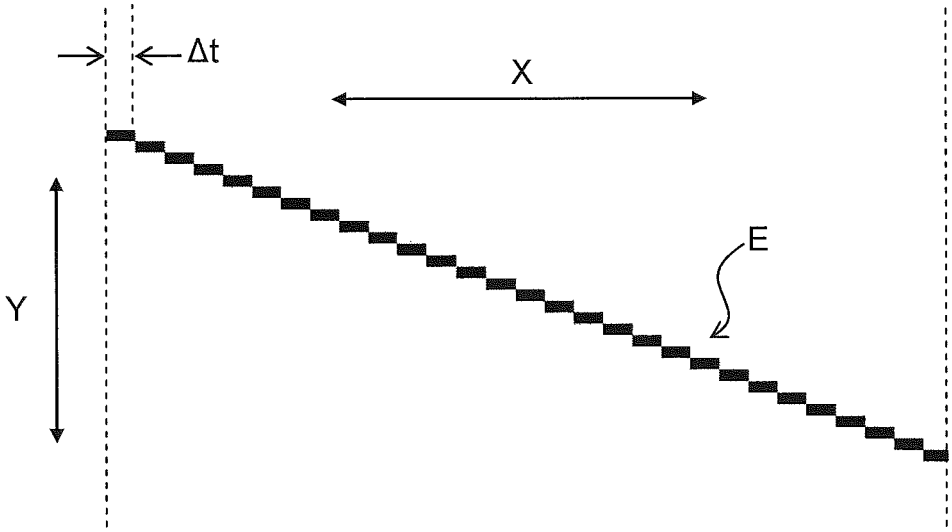
FIG. 4 is a diagram showing one example of an exposure pattern used in the contamination state check mode.
Figure 5:
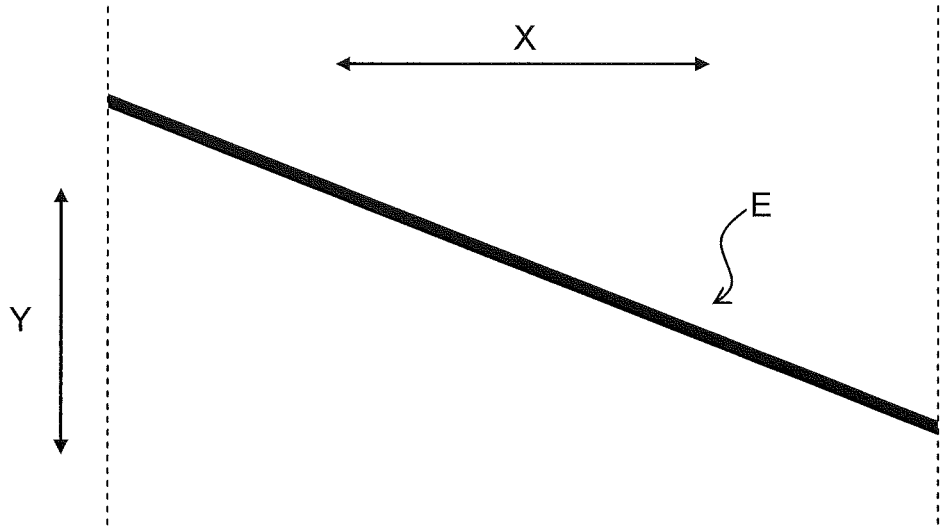
FIG. 5 is a diagram showing another example of an exposure pattern used in the contamination state check mode.

The exposure pattern E is not limited to the stepwise pattern shown in FIG. 4; it may instead be a pattern describing a straight line as shown in FIG. 5. That is, the surface of the photosensitive drum 5 may be exposed to light in an exposure pattern E that extends continuously over its entire area in the main scanning direction while being displaced at a constant rate in the sub-scanning direction. It is, however, preferable to use an exposure pattern E formed by displacing a plurality of blocks, which are continuous in the main scanning direction, in steps in the sub-scanning direction as shown in FIG. 4 so that local variation of the charging current Ipc in the axial direction of the charging roller 41 can be detected more accurately.

Then, as the photosensitive drum 5 rotates, the exposure pattern E reaches the charging roller 41 (time point T2). The blocks of the exposure pattern E are displaced in steps in the sub-scanning direction, and thus the blocks pass through the charging roller 41 sequentially in order from one end to the other end of the exposure pattern E. Here, the surface of the photosensitive drum 5 is refilled with electric charge to compensate for attenuation by exposure to light, and to that end, the charging current Ipc1 passes from the charging roller 41 sequentially to the blocks of the exposure pattern E on the surface of the photosensitive drum 5. This charging current Ipc is sampled for all the blocks by the current detector 43*c* a plurality of times (for example 10 times) per block.

Then, when the entire area of the exposure pattern E has passed through the charging roller 41 (time point T3), the charging current Ipc again ceases to pass (becomes Ipc0). After the exposure of the exposure pattern E to light has been completed, and the charging current Ipc has been sampled for all the blocks, the electric current to the destaticizer 6 is turned on to remove the electric charge remaining on the surface of the photosensitive drum 5 to permit regular start-up operation of the image forming apparatus 100 to proceed.

Figure 6:
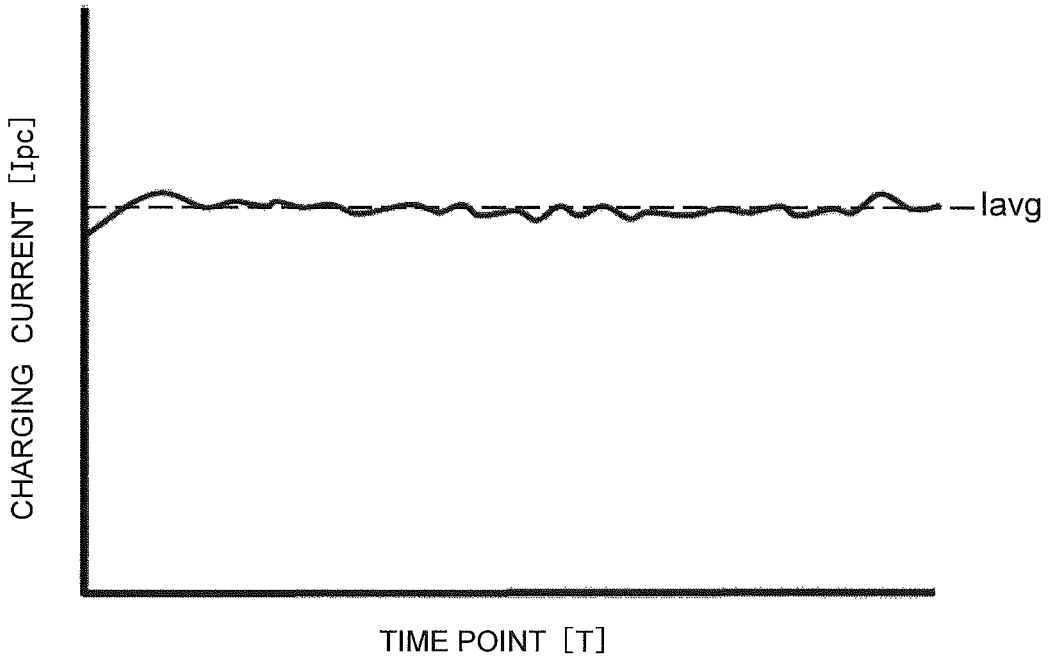
FIG. 6 is a partly enlarged view of time variation of the charging current while the exposure pattern passes through the charging roller, showing a state where the charging roller is not contaminated.
Figure 7:
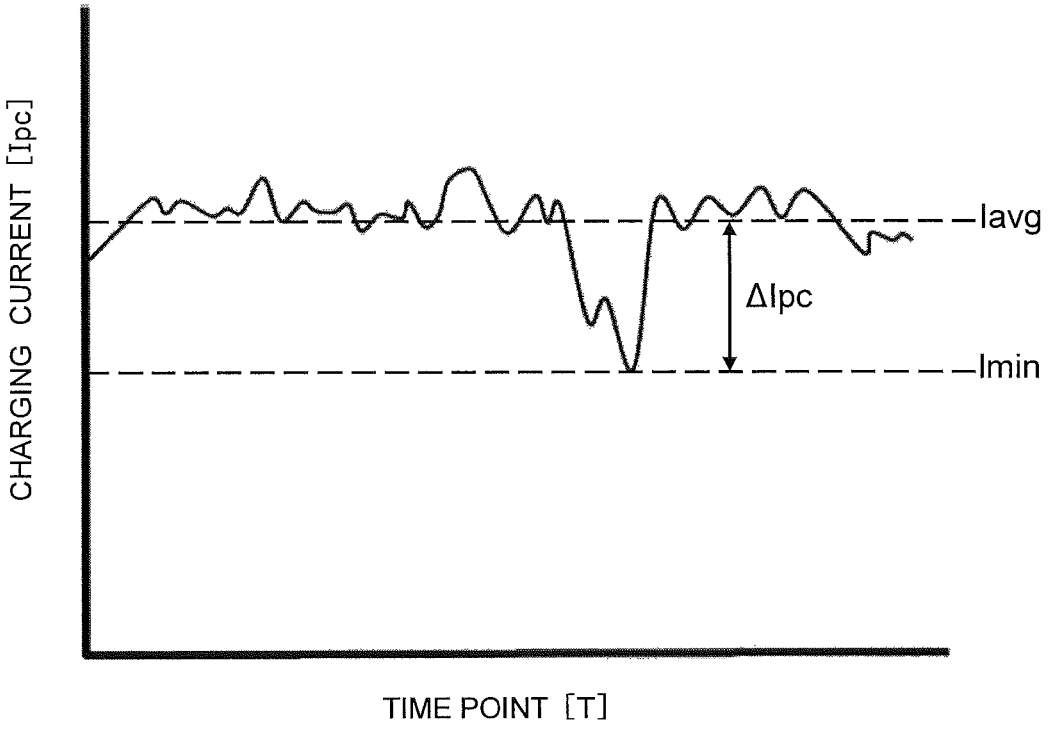
FIG. 7 is a partly enlarged view of time variation of the charging current while the exposure pattern passes through the charging roller, showing a state where the charging roller is locally contaminated.

FIGS. 6 and 7 are partly enlarged views of the time variation of the charging current Ipc observed while the exposure pattern E in FIG. 4 passes through the charging roller 41 (from time point T2 to T3). The blocks of the exposure pattern E have the same exposure area, and thus, when the charging roller 41 is not contaminated with toner external additive or the like, the charging current Ipc substantially equals a given value (Ipc1) as shown in FIG. 6.

On the other hand, when a part of the charging roller 41 is contaminated with toner external additive or the like, as shown in FIG. 7, the charging current Ipc locally drops. Thus, it is possible to check the contamination state of the charging roller 41 in its axial direction by comparing the average value of the charging current with the minimum value of the charging current for all the blocks of the exposure pattern E.

Specifically, the average current Iavg is calculated from the charging current Ipc sampled for all the blocks of the exposure pattern E. The minimum value Imin is simultaneously calculated also from the charging current Ipc sampled for all the blocks. Then, if comparing the average value Iavg with the minimum value Imin reveals that there is a block of which the charging current Ipc is lower than a predetermined value (the variation width ΔIpc is equal to or larger than a predetermined width), it is determined that the charging roller 41 is locally contaminated.

The results of the study reveal that, if the charging current Ipc locally drops by 30% or more, defects locally appear in the form of vertical stripes or fogginess in an image. Thus, if printing continues to be performed with a local drop of 20% in the charging current ΔIpc, eventually, the charging current Ipc locally drops by 30%; this may cause vertical stripes and fogginess in an image.

Thus, when a part of the charging current Ipc drops by 20%, it is determined that the charging roller 41 is close to the end of its life, and for example, a notification that prompts the replacement of the charging roller 41 is transmitted as a CBM (condition based maintenance) alert from the transmitting-receiving unit 91 to a communication terminal of a service person who performs maintenance. In this way, it is possible to notify the service person that the charging roller 41 is close to the end of its life and to reliably perform proactive maintenance on the image forming apparatus 100. It is also possible to minimize the burden of monitoring by a service person and the maintenance cost.

With the above-described control, even when a part of the charging roller 41 in its axial direction is contaminated, it is possible to accurately detect the contamination state of the charging roller 41 and the resulting local drop in its chargeability. Thus, it is possible to reliably keep track of the contamination status of the charging roller 41 and notify the appropriate time for replacement of the charging roller 41, and to effectively prevent vertical stripes and fogginess from appearing in an image due to failure to electrostatically charge the photosensitive drum 5.

The embodiments described above are in no way meant to limit the present disclosure, which thus allows for many modifications and variations within the spirit of the present disclosure. For example, although, in the above-described embodiment, by use of the transmitting-receiving unit 91, a service person is directly notified that the charging roller 41 is close to the end of its life; instead, for example, a notification that prompts the replacement of the charging roller 41 may be displayed on the liquid crystal display 90 to notify a user that the charging roller 41 is close to the end of its life.

Although the above-described embodiment deals with, as an example of the image forming apparatus 100, a monochrome printer like the one shown in FIG. 1, this is not meant as any limitation to a monochrome printer; instead, any other type of image forming apparatus such as a monochrome copier, a color copier, a digital multifunction peripheral, a color printer, or a facsimile machine may be used.

The present disclosure is applicable to an image forming apparatus provided with a charging device of a contact charging type which electrostatically charges an image carrying member by use of a charging member in contact with the image carrying member. Based on the present disclosure, it is possible to provide an image forming apparatus that can accurately estimate the life of a charging member by detecting local contamination of the charging member in the main scanning direction.

What is claimed is:

1. An image forming apparatus comprising:

an image carrying member on a surface of which a photosensitive layer is formed;

a charging member which makes contact with the surface of the image carrying member and electrostatically charges the image carrying member;

an exposing device which scans, while exposing to light, the surface of the image carrying member electrostatically charged by the charging member to form an electrostatic latent image on the image carrying member;

a destaticizer which removes electric charge remaining on the surface of the image carrying member;

a high-voltage generation circuit which applies an oscillating voltage having a DC voltage and an AC voltage superimposed on each other to the charging member;

a current detector which detects a charging current that passes between the charging member and the image carrying member; and a controller which controls the high-voltage generation circuit, wherein the controller is configured to execute a contamination state check mode including:

a potential saturation step where, when no image is being formed, a surface potential of the image carrying member is saturated by applying the DC voltage alone to the charging member and stopping a drive of the destaticizer;

an exposure step where the image carrying member of which the surface potential is saturated in the potential saturation step is exposed to light in an exposure pattern extending continuously over an entire area thereof in a main scanning direction while being displaced at a constant rate in a sub-scanning direction by the exposing device; and a current detection step where the charging current that passes while the exposure pattern formed on the surface of the image carrying member in the exposure step passes through the charging member is detected by the current detector, the contamination state check mode being a mode in which a contamination state of the charging member in the main scanning direction is checked based on the charging current detected in the current detection step.

2. The image forming apparatus of claim 1, wherein the exposure pattern is formed by displacing a plurality of blocks, which are continuous in the main scanning direction, in steps in the sub-scanning direction.

3. The image forming apparatus of claim 2, wherein in the exposure pattern, the blocks each have an exposure duration 10 times or more of a reading period for detection of the charging current by the current detector.

4. The image forming apparatus of claim 1, wherein the exposure pattern has a length in the sub-scanning direction equal to or smaller than a circumference of the image carrying member.

5. The image forming apparatus of claim 1, wherein the controller determines that the charging member is contaminated when a variation width of a minimum value of the charging current relative to an average value of the charging current detected over the entire exposure pattern in the current detection step is equal to or higher than a predetermined value.

6. The image forming apparatus of claim 2, wherein the controller calculates an average value of the charging current sampled for all the blocks of the exposure pattern and a minimum value of the charging current sampled for all the blocks, and, when there is a block for which a variation width of the minimum value relative to the average value is equal to or higher than the predetermined value, determines that the charging member is contaminated in the block.

7. The image forming apparatus of claim 5, further comprising:

a notification device which notifies the contamination state of the charging member determined by the controller, wherein the controller gives a notification that prompts replacement of the charging member by use of the notification device when the variation width of the minimum value of the charging current relative to the average value of the charging current is equal to or higher than the predetermined value.

8. The image forming apparatus of claim 1, wherein when printing is not performed continuously for a predetermined period, the controller enters an energy-saving mode in which supply of electric power to components and devices constituting the image forming apparatus is limited, and the controller executes the contamination state check mode when power to the image forming apparatus is turned on, on recovery from the energy-saving mode, or every predetermined number of printed sheets after last execution of the contamination state check mode.

* * * * *